US008011196B2

(12) United States Patent
Eber et al.

(10) Patent No.: US 8,011,196 B2
(45) Date of Patent: Sep. 6, 2011

(54) REFRIGERANT CONTROL OF A HEAT-RECOVERY CHILLER

(75) Inventors: Alan Hv Eber, La Crosse, WI (US); Steven J. Pitts, LaCrescent, MN (US); Brian T. Sullivan, La Crosse, WI (US)

(73) Assignee: Trane International Inc., Piscataway, NJ (US)

( * ) Notice: Subject to any disclaimer, the term of this patent is extended or adjusted under 35 U.S.C. 154(b) by 928 days.

(21) Appl. No.: 12/004,783

(22) Filed: Dec. 20, 2007

(65) Prior Publication Data

US 2009/0158762 A1 Jun. 25, 2009

(51) Int. Cl.
*F25B 41/00* (2006.01)
*F25B 5/00* (2006.01)

(52) U.S. Cl. ..... 62/196.4; 62/117

(58) Field of Classification Search ..... 62/196.4, 62/196.1, 196.3, 197, 199, 200, 502, 509, 62/216, 219; 165/114
See application file for complete search history.

(56) References Cited

U.S. PATENT DOCUMENTS 2,079,687 A * 5/1937 Fourness ..... 62/335
2,921,445 A 1/1960 Ashley et al.
3,112,618 A 12/1963 Weller
3,241,331 A 3/1966 Endress et al.
3,299,653 A 1/1967 Osborne
3,367,125 A 2/1968 McGrath
3,499,296 A 3/1970 Osborne
3,805,101 A 4/1974 Purman
3,805,547 A * 4/1974 Eber ..... 62/505
4,448,597 A * 5/1984 Kuwabara et al. ..... 62/176.6
4,475,354 A * 10/1984 Akerhielm et al. ..... 62/117
6,293,119 B1 * 9/2001 Wenzel ..... 62/238.6
RE40,499 E * 9/2008 Lifson ..... 62/196.2

* cited by examiner

*Primary Examiner* — Frantz Jules
*Assistant Examiner* — Timothy K Trieu
(74) *Attorney, Agent, or Firm* — William O'Driscoll

(57) ABSTRACT

A chiller includes a main condenser that has a refrigerant condensate sump with an internal weir or standpipe that maintains at least a minimum liquid seal between the outlets of the main condenser and a heat-recovery condenser. The main condenser is used for normal cooling operation, and the heat-recovery condenser is for supplying an external process with heat that would otherwise be wasted. In addition to providing a liquid seal, the sump and weir combination provides a reliable source of liquid refrigerant to cool the chiller's compressor motor and creates a trap for collecting foreign particles that might exit either of the chiller's two condensers.

22 Claims, 3 Drawing Sheets

REFRIGERANT CONTROL OF A HEAT-RECOVERY CHILLER

FIELD OF THE INVENTION

The subject invention generally pertains to refrigerant chillers and more specifically to a chiller that includes a main condenser and a heat-recovery condenser.

BACKGROUND OF RELATED ART

With conventional refrigerant systems, known as chillers, an evaporator provides a cooling effect that can be used wherever needed, and a main condenser releases waste heat to atmosphere. In cases where there is a use for the waste heat, such as, for example, to heat domestic water or to heat some other external process, a chiller may be provided with a second condenser or heat-recovery condenser. Instead of the main condenser releasing heat to the atmosphere, heat from the heat-recovery condenser can be used for driving the external process. Depending on the need for heat, the chiller might switch between which of its two condensers it activates, or perhaps the two condensers might operate simultaneously to share the condensing function.

When activating a heat-recovery condenser while deactivating the main one, it can be difficult avoiding adverse refrigerant flow between the two. Some gaseous refrigerant from an inactive main condenser, for instance, might flow counter to that of liquid refrigerant leaving the heat-recovery condenser. Such counter flow of fluids can reduce the system's overall effectiveness.

In some cases, the flow pattern of gaseous refrigerant flowing from an inactive main condenser to an active heat-recovery condenser can produce a pressure drop sufficient to create an excessively high pressure differential between the two condensers. An excessive pressure differential can force liquid refrigerant to back up into the shell of the heat-recovery condenser, which reduces the chiller's performance in the a heat-recovery mode.

Due to the drawbacks of current heat-recovery chiller systems, there is a need for a refrigerant system that can recover waste heat more effectively without adverse system effects.

SUMMARY OF THE INVENTION

It is an object of the present invention to provide a heat-recovery chiller system that includes a liquid seal or gas trap between the outlets of two condensers, wherein the gas trap has a liquid head that is kept above a minimum level yet is below the bottom of the heat-recovery condenser.

Another object of some embodiments is to provide a heat-recovery chiller with a condensate sump that includes an internal weir to create a reliable source of liquid refrigerant to cool the chiller's compressor motor.

Another object of some embodiments is to provide a chiller with a refrigerant flow path to and through the heat-recovery condenser in such a way as to minimize the pressure differential between the chiller's two condensers.

Another object of some embodiments is to bias the position of a heat exchanger tube bundle toward the bottom of a heat-recovery condenser so as to create above the tubes an open passageway for gaseous refrigerant to flow. This creates within the condenser generally unidirectional flow from above the tube bundle to a drain tube that is below the tubes.

Another object of some embodiments is avoid creating a counter flow pattern of liquid and gaseous refrigerant leaving and entering a heat-recovery condenser.

Another object of some embodiments is to provide a heat-recovery chiller with a condensate sump that includes an internal weir that produces a trap for collecting relatively heavy debris that might exit either of the chiller's two condensers.

One or more of these and/or other objects of the invention are provided by a chiller with a heat-recovery condenser, wherein the chiller includes a condensate sump with an internal weir.

DESCRIPTION OF THE PREFERRED EMBODIMENT

Figure 1:
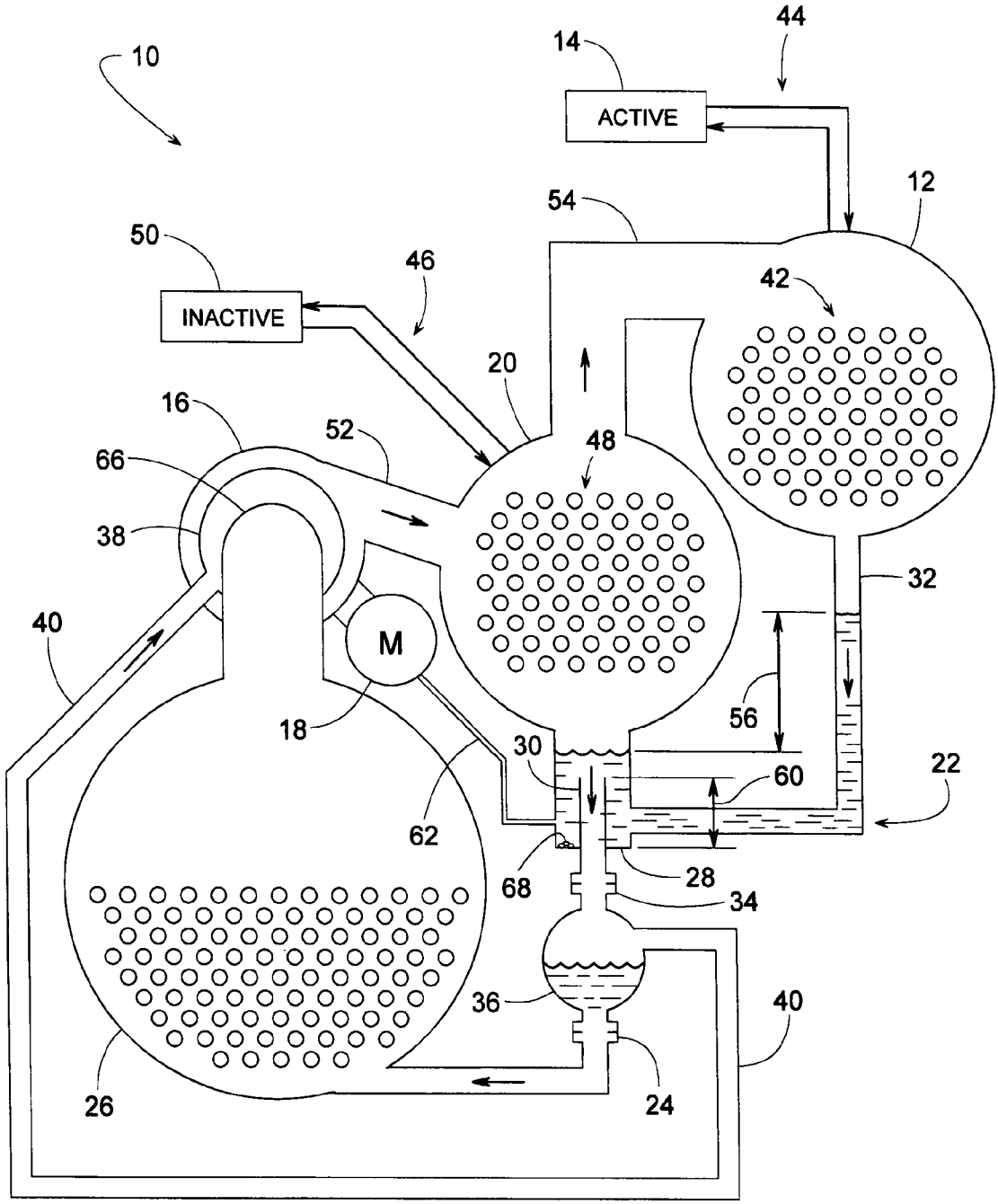
FIG. 1 is a schematic view of a chiller in a heat-recovery mode.
Figure 2:
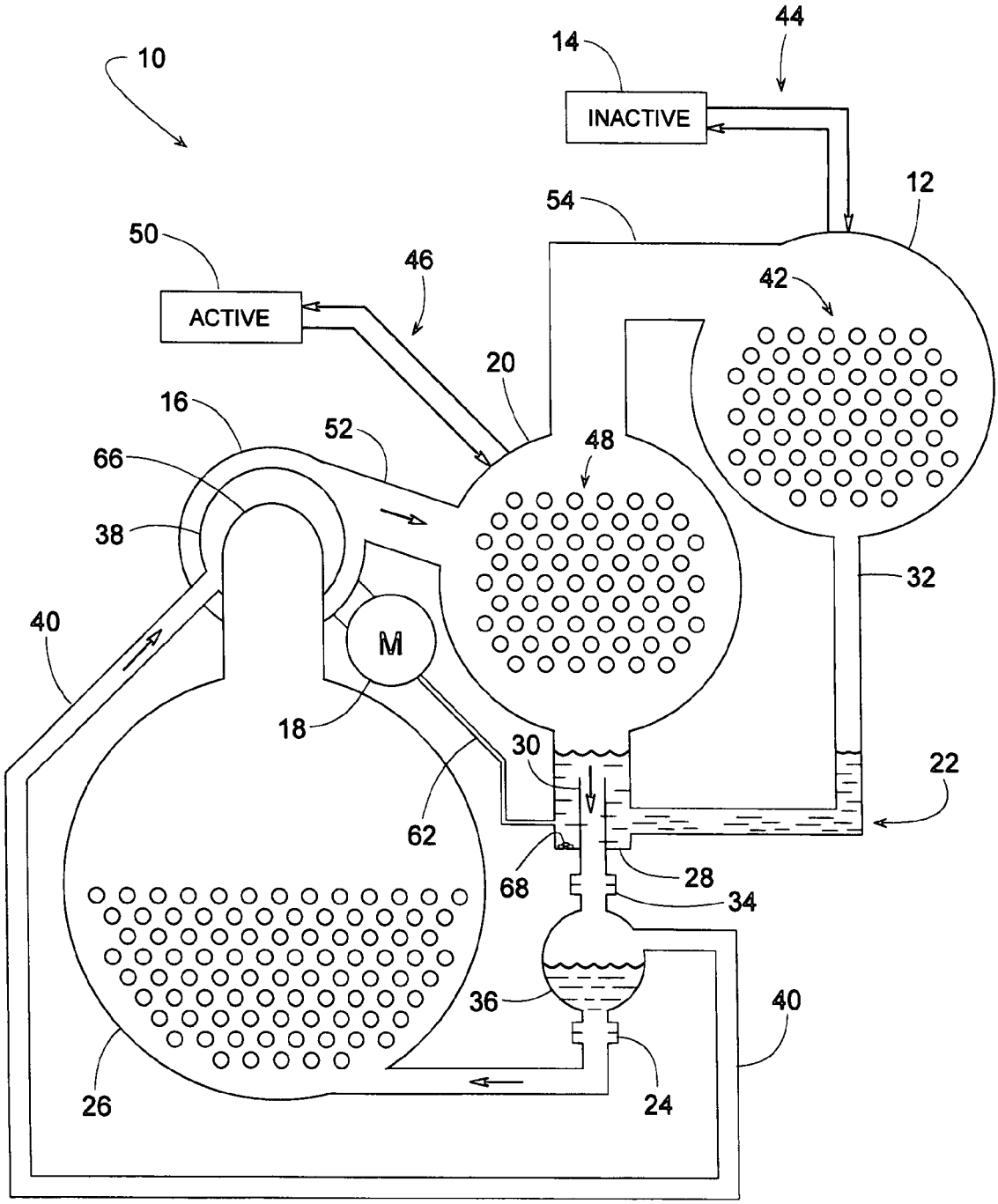
FIG. 2 is a schematic view of the chiller in FIG. 1 but with the chiller operating in a non-heat-recovery mode.
Figure 3:
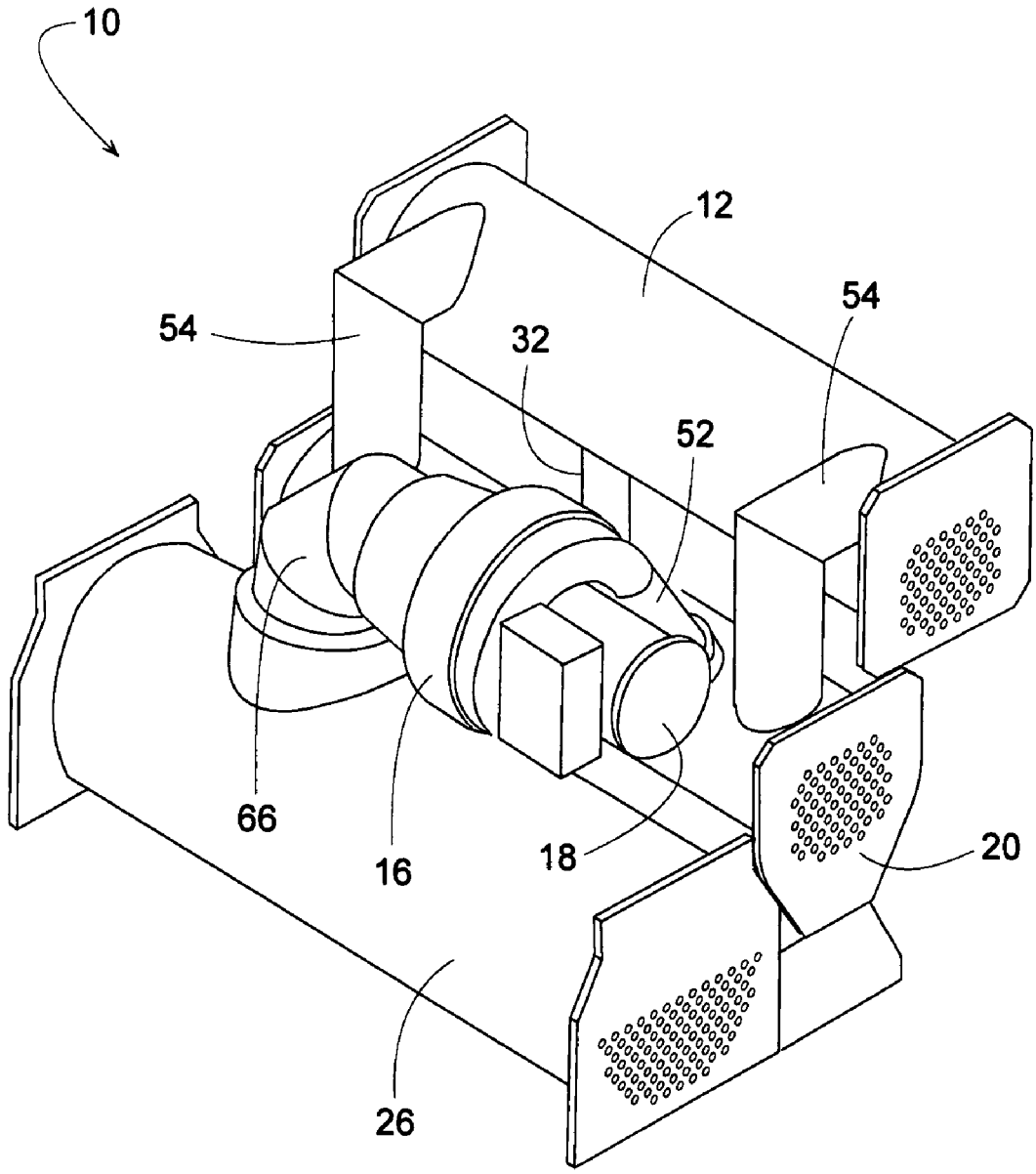
FIG. 3 is a perspective view of the chiller of FIGS. 1 and 2.

FIGS. 1-3 illustrate a refrigerant system 10, which can be referred to as a heat-recovery chiller, as system 10 includes a second condenser 12 that can transfer heat to an external process 14 that recovers otherwise wasted heat. Second condenser 12 is preferably, but not necessarily, a shell-and-tube heat exchanger. Process 14 can be anything that can use heat from second condenser 12. Examples of process 14 include, but are certainly not limited to, heating domestic water, heating a swimming pool, or heating water used in some type of manufacturing process.

In some cases, system 10 comprises a single or multistage refrigerant compressor 16 (e.g., centrifugal, screw, scroll, reciprocating, etc.) driven by a motor 18, a main condenser 20 (e.g., shell-and-tube heat exchanger) for condensing the refrigerant discharged from compressor 16, the alternate second condenser 12, a gas trap 22 between the outlets of condensers 12 and 20, a main expansion device 24 (e.g., orifice plate, capillary tube, flow-throttling valve, or some other type of flow restriction) for cooling the refrigerant by expansion, and an evaporator 26 for transferring the cooling effect to a building or some other application. Gas trap 22 is created by the combination of a condensate sump 28 at the bottom of main condenser 20, a weir 30 inside sump 28, and a drain tube 32 that runs from the bottom of second condenser 12 to condensate sump 28.

For the illustrated embodiment, system 10 also includes an intermediate expansion device 34 and an economizer 36 that through a line 40 provides flashed refrigerant gas at intermediate pressure to an intermediate stage 38 of compressor 16. Economizer 36 is schematically illustrated to represent any system for feeding a multistage compressor with refrigerant at intermediate pressure.

Condensers 12 and 20 can be separately operated in active or inactive modes. When external process 14 demands heat, second condenser 12 can be active while main condenser 20 is inactive, as shown in FIG. 1. When process 14 no longer needs heat, as shown in FIG. 2, second condenser 12 can be inactive while main condenser 20 is active to continue supporting the system's cooling needs. Partial and/or combined activation of condensers 12 and 20 is also well within the scope of the invention.

Selectively activating and deactivating second condenser 12 can be accomplished by controlling the volume of cooling fluid (e.g., water) pumped between process 14 and a bundle of heat exchanger tubes 42 inside the shell of condenser 12. Lines 44 schematically represent pipes that convey cooling fluid between process 14 and tubes 42. Likewise, controlling the volume of cooling fluid through lines 46 is one way of activating and deactivating main condenser 20, wherein lines 46 convey fluid between heat exchanger tubes 48 of condenser 20 and a heat-releasing system 50 (e.g., a cooling tower or air-cooled heat exchanger). Lines 44 and 46 can be and preferably are two separate circuits.

In operation, compressor 16 discharges generally hot pressurized refrigerant gas through an outlet 52 of compressor 16 and into main condenser 20. During a heat-recovery mode, as shown in FIG. 1, second condenser 12 is much cooler than main condenser 20, so the refrigerant discharged from compressor 16 passes through inactive condenser 20 and is drawn into active condenser 12 via one or preferably a plurality of refrigerant feed pipes 54. Relatively cool fluid being pumped between process 14 and tubes 42 condenses the refrigerant within second condenser 12.

As the refrigerant condenses, drain tube 32 drains the refrigerant condensate from the bottom of second condenser 12 to sump 28. The liquid refrigerant in drain tube 32 and sump 28 provides a liquid seal of variable liquid head 56 between the outlets of condensers 12 and 20. This liquid seal (gas trap 22) promotes unidirectional flow through feed pipes 54 and drain tube 32. The unidirectional flow means that gaseous refrigerant does not backflow up through drain tube 32, wherein such backflow of gas could obstruct the flow of condensate attempting to drain down through the same line.

The variable liquid head 56 of gas trap 22 is due to the pressure differential between condensers 12 and 20. Liquid head 56 is generally greatest when second condenser 12 is active during the heat-recovery mode, as shown in FIG. 1. To prevent the liquid level in drain tube 32 from rising into second condenser 12 itself, the pressure differential between condensers 12 and 20 can be minimized by minimizing any flow restriction to refrigerant gas flowing to and through second condenser 12.

In a currently preferred embodiment, minimal flow restriction is achieved in several ways. One, feed pipe 54 is relatively large (i.e., pipe 54 has an inner diameter that is larger than that of drain tube 32). Two, the bundle of heat exchanger tubes 42 is biased toward the bottom of second condenser 12 to create a more wide open flow path above tubes 42 for gaseous refrigerant to enter and flow through the shell of condenser 12. And three, instead of a single feed pipe 54, refrigerant from main condenser 20 can flow through two or more feed pipes connected in parallel flow relationship with each other, as shown in FIG. 3.

Head 56 is appreciably less or even zero when second condenser 12 is inactive, as shown in FIG. 2. In any case, weir 30 in sump 28 helps maintain the liquid seal with at least a minimum level of liquid refrigerant, as depicted by dimension 60 of FIG. 1. In a currently preferred embodiment, weir 30 is in the form of a standpipe; however, other overflow devices (e.g., spillover plate) are well within the scope of the invention.

In addition to providing system 10 with gas trap 22, sump 28 and weir 30 also provide a reliable source of liquid refrigerant for a motor cooling line 62. Line 62 conveys liquid refrigerant from sump 28 into the housing of motor 18, thus cooling motor 18. After cooling motor 18, the refrigerant can be returned to the rest of the refrigerant circuit by any suitable means such as, for example, by flowing through a line or passageway leading to a compressor inlet 66 or some other low-pressure side of system 10. Sump 28 and weir 30 also provide a trap for collecting debris and foreign particles 68 that may have circulated through refrigerant system 10.

Although the invention is described with respect to a preferred embodiment, modifications thereto will be apparent to those of ordinary skill in the art. The scope of the invention, therefore, is to be determined by reference to the following claims:

The invention claimed is:

1. A refrigerant system for handling liquid and gaseous refrigerant, comprising:

a compressor that defines a compressor inlet and a compressor outlet;

a main condenser connected in fluid communication with the compressor outlet;

an evaporator connected in fluid communication with the compressor inlet;

a main expansion device connected in fluid communication with the main condenser and the evaporator such that the main expansion device is downstream of the main condenser and upstream of the evaporator;

a second condenser connected in bypass flow relationship with the main condenser;

a condensate sump connected to receive the refrigerant from at least one of the main condenser and the second condenser, the condensate sump is also connected to release the refrigerant to the main expansion device;

a weir disposed within the condensate sump to help maintain a minimum level of liquid refrigerant therein; and a drain tube connecting the second condenser in fluid communication with the condensate sump such that the drain tube, the weir and the condensate sump provide a gas trap between the main condenser and the second condenser.

2. The refrigerant system of claim 1, wherein the gas trap provides a variable liquid head between the main condenser and the second condenser, and the second condenser is selectively operable in an active mode and an inactive mode such that the variable liquid head is greater in the active mode than in the inactive mode.

3. The refrigerant system of claim 1, wherein the compressor is driven by a motor and further comprising a liquid cooling line that connects the motor in fluid communication with the condensate sump.

4. The refrigerant system of claim 1, further comprising:

an intermediate expansion device connected in fluid communication with the condensate sump; and an economizer defining an economizer inlet connected in fluid communication with the intermediate expansion device and an economizer outlet connected in fluid communication with the main expansion device, and a line connecting the economizer in fluid communication with the compressor, the line being downstream of the economizer inlet and upstream of the economizer outlet.

5. The refrigerant system of claim 1, wherein the weir is comprised of a standpipe that conveys liquid refrigerant from at least one of the main condenser and the second condenser and releases the liquid refrigerant toward the main expansion device.

6. The refrigerant system of claim 1, wherein the condensate sump provides a trap for collecting foreign particles that may have circulated through the refrigerant system.

7. The refrigerant system of claim 1, further comprising plurality of refrigerant feed pipes that connect the main condenser to an upper portion of the second condenser, the plurality of refrigerant feed pipes are in parallel flow relationship with each other with respect to refrigerant flow.

8. The refrigerant system of claim 1, further comprising a bundle of heat exchanger tubes disposed within the second condenser, wherein the bundle of heat exchanger tubes are biased toward a lower portion of the second condenser.

9. The refrigerant system of claim 1, further comprising a refrigerant feed pipe that connects the main condenser in fluid communication with the second condenser, wherein the refrigerant feed pipe is of a greater diameter than that of the drain tube.

10. The refrigerant system of claim 1, wherein the second condenser is higher than the main condenser.

11. A refrigerant system for handling liquid and gaseous refrigerant, comprising:

a compressor that defines a compressor inlet and a compressor outlet;

a main condenser connected in fluid communication with the compressor outlet;

an evaporator connected in fluid communication with the compressor inlet;

a main expansion device connected in fluid communication with the main condenser and the evaporator such that the main expansion device is downstream of the main condenser and upstream of the evaporator;

a second condenser connected in bypass flow relationship with the main condenser, wherein the second condenser is higher than the main condenser;

a condensate sump connected to receive the refrigerant from at least one of the main condenser and the second condenser, the condensate sump is also connected to release the refrigerant to the main expansion device;

a weir disposed within the condensate sump to help maintain a minimum level of liquid refrigerant therein;

a drain tube connected to a lower portion of the second condenser, the drain tube connects the second condenser in fluid communication with the condensate sump such that the drain tube, the weir and the condensate sump provide a gas trap between the main condenser and the second condenser, wherein the gas trap provides a variable liquid head between the main condenser and the second condenser, and the second condenser is selectively operable in an active mode and an inactive mode such that the variable liquid head is greater in the active mode than in the inactive mode; and a refrigerant feed pipe connected to an upper portion of the second condenser, the refrigerant feed pipe connects the main condenser in fluid communication with the second condenser, wherein the refrigerant feed pipe is of a greater diameter than that of the drain tube.

12. The refrigerant system of claim 11, wherein the compressor is driven by a motor and further comprising a liquid cooling line that connects the motor in fluid communication with the condensate sump.

13. The refrigerant system of claim 11, further comprising:

an intermediate expansion device connected in fluid communication with the condensate sump; and an economizer defining an economizer inlet connected in fluid communication with the intermediate expansion device and an economizer outlet connected in fluid communication with the main expansion device, and a line connecting the economizer in fluid communication with the compressor.

14. The refrigerant system of claim 11, wherein the weir is comprised of a standpipe that conveys liquid refrigerant from at least one of the main condenser and the second condenser and releases the liquid refrigerant toward the main expansion device.

15. The refrigerant system of claim 11, wherein the condensate sump provides a trap for collecting foreign particles that may have circulated through the refrigerant system.

16. The refrigerant system of claim 11, further comprising a plurality of refrigerant feed pipes that connect the main condenser to the second condenser, the plurality of refrigerant feed pipes are in parallel flow relationship with each other with respect to refrigerant flow.

17. The refrigerant system of claim 11, further comprising a bundle of heat exchanger tubes disposed within the second condenser, wherein the bundle of heat exchanger tubes are biased toward a lower portion of the second condenser, the bundle of heat exchanger tubes are above the drain tube and below where the refrigerant feed pipe feeds into the second condenser.

18. A refrigerant system for handling liquid and gaseous refrigerant, comprising:

a compressor that defines a compressor inlet and a compressor outlet, wherein the compressor is driven by a motor;

a main condenser connected in fluid communication with the compressor outlet;

an evaporator connected in fluid communication with the compressor inlet;

a main expansion device connected in fluid communication with the main condenser and the evaporator such that the main expansion device is downstream of the main condenser and upstream of the evaporator;

a second condenser connected in bypass flow relationship with the main condenser, wherein the second condenser is higher than the main condenser;

a condensate sump connected to receive the refrigerant from at least one of the main condenser and the second condenser, the condensate sump is also connected to release the refrigerant to the main expansion device;

a weir disposed within the condensate sump to help maintain a minimum level of liquid refrigerant therein;

a drain tube connected to a lower portion of the second condenser, the drain tube connects the second condenser in fluid communication with the condensate sump such that the drain tube, the weir and the condensate sump provide a gas trap between the main condenser and the second condenser, wherein the gas trap provides a variable liquid head between the main condenser and the second condenser, and the second condenser is selectively operable in an active mode and an inactive mode such that the variable liquid head is greater in the active mode than in the inactive mode;

a refrigerant feed pipe connected to an upper portion of the second condenser, the refrigerant feed pipe connects the main condenser in fluid communication with the second condenser, wherein the refrigerant feed pipe is of a greater diameter than that of the drain tube;

a liquid cooling line that connects the motor in fluid communication with the condensate sump;

an intermediate expansion device connected in fluid communication with the condensate sump; and an economizer defining an economizer inlet connected in fluid communication with the intermediate expansion device and an economizer outlet connected in fluid communication with the main expansion device, and a line connecting the economizer in fluid communication with the compressor.

19. The refrigerant system of claim 18, wherein the weir is comprised of a standpipe that conveys liquid refrigerant from at least one of the main condenser and the second condenser and releases the liquid refrigerant toward the main expansion device.

20. The refrigerant system of claim 18, wherein the condensate sump provides a trap for collecting foreign particles that may have circulated through the refrigerant system.

21. The refrigerant system of claim 18, further comprising a plurality of refrigerant feed pipes connected to the upper portion of the second condenser, the plurality of refrigerant feed pipes connect the main condenser to the second condenser, the plurality of refrigerant feed pipes are in parallel flow relationship with each other with respect to refrigerant flow.

22. The refrigerant system of claim 18, further comprising a bundle of heat exchanger tubes disposed within the second condenser, wherein the bundle of heat exchanger tubes are biased toward the lower portion of the second condenser, the bundle of heat exchanger tubes are above the drain tube and below where the refrigerant feed pipe feeds into the second condenser.

* * * * *